US006981350B1

(12) United States Patent
Redmon

(10) Patent No.: US 6,981,350 B1
(45) Date of Patent: Jan. 3, 2006

(54) PROJECTION SCREEN APPARATUS

(75) Inventor: Shanon O. Redmon, Greenfield, IN (US)

(73) Assignee: Draper, Inc., Spiceland, IN (US)

( * ) Notice: Subject to any disclaimer, the term of this patent is extended or adjusted under 35 U.S.C. 154(b) by 119 days.

(21) Appl. No.: 10/350,603

(22) Filed: Jan. 24, 2003

(51) Int. Cl.
*G09F 15/00* (2006.01)

(52) U.S. Cl. ..... 52/646; 52/109; 40/610; 359/443

(58) Field of Classification Search ..... 52/109, 52/646; 40/610; 359/443; 24/182, 183
See application file for complete search history.

(56) References Cited

U.S. PATENT DOCUMENTS

| | | | |
|---|---|---|---|
| 2,386,450 | A | 10/1945 | Eller |
| 2,602,252 | A | 7/1952 | Shinn |
| 2,708,559 | A | 5/1955 | Du Mais |
| 2,825,518 | A | 3/1958 | Cooley, Sr. et al. |
| 2,845,244 | A | 7/1958 | Prokop |
| 2,886,274 | A | 5/1959 | Petrick |
| 2,899,164 | A | 8/1959 | Nicholas et al. |
| 2,905,420 | A | 9/1959 | Petrick |
| 2,919,094 | A | 12/1959 | Petrick |
| 3,003,729 | A | 10/1961 | Petrick |
| 3,041,032 | A | 6/1962 | Wilcox |
| 3,087,535 | A | 4/1963 | Müller |
| 3,100,573 | A | 8/1963 | Cox |
| 3,164,348 | A | 1/1965 | Armstrong |
| 3,164,349 | A | 1/1965 | Armstrong |
| 3,168,134 | A | 2/1965 | Guske |
| 3,190,597 | A | 6/1965 | Bieschke |
| 3,205,772 | A | 9/1965 | Guske |
| 3,214,121 | A | 10/1965 | Armstrong |
| 3,236,286 | A | 2/1966 | Jacobson |
| 3,236,287 | A | 2/1966 | Jacobson |
| 3,245,644 | A | 4/1966 | Kozel |
| 3,282,545 | A | 11/1966 | Bieschke |
| 3,309,049 | A | 3/1967 | Albee, Jr. |
| 3,314,167 | A | 4/1967 | Allgood |
| 3,315,930 | A | 4/1967 | Cota |
| 3,321,163 | A | 5/1967 | Petrick |
| 3,321,164 | A | 5/1967 | Petrick |
| 3,324,928 | A | 6/1967 | Müller |
| 3,417,952 | A | 12/1968 | Bieschke |
| 3,601,916 | A | 8/1971 | Epstein |
| 3,696,856 | A | 10/1972 | Potler |
| 3,841,594 | A | 10/1974 | Zinn |
| 3,868,078 | A | 2/1975 | Zinn |
| 3,942,869 | A | 3/1976 | Portner et al. |
| 4,001,987 | A | 1/1977 | Coulthard |
| 4,017,152 | A | 4/1977 | Allen |
| 4,068,921 | A | 1/1978 | Okumura |
| 4,097,013 | A | 6/1978 | Broome |
| 4,110,003 | A | 8/1978 | Zinn |
| 4,471,548 | A | 9/1984 | Goudie |
| 4,479,340 | A | 10/1984 | Alphonse et al. |
| 4,512,097 | A | 4/1985 | Zeigler |
| 4,580,375 | A | 4/1986 | Nodskov et al. |
| 4,631,849 | A | 12/1986 | Jeffery |

(Continued)

OTHER PUBLICATIONS

"Smart Displays Graphic Exhibit Displays Make a Smart Choice" brochure from Smart Display, USA, date unknown, 6 pages.

(Continued)

*Primary Examiner*—Peter R. Brown
(74) *Attorney, Agent, or Firm*—Baker & Daniels LLP

(57) ABSTRACT

A projection screen apparatus is disclosed for displaying an image projected by a projector. The projection screen apparatus includes a collapsible frame and a removable display sheet.

18 Claims, 13 Drawing Sheets

U.S. PATENT DOCUMENTS

| | | | |
|---|---|---|---|
| 4,658,560 | A | 4/1987 | Beaulieu |
| 4,663,899 | A | 5/1987 | Nodskov et al. |
| 4,791,761 | A | 12/1988 | Goudie |
| 4,800,663 | A | 1/1989 | Zeigler |
| 4,809,471 | A | 3/1989 | Wichman et al. |
| 4,888,895 | A | 12/1989 | Kemeny |
| 4,942,686 | A | 7/1990 | Kemeny |
| 4,986,016 | A | 1/1991 | Wichman |
| 5,078,348 | A | 1/1992 | Babitchenko |
| 5,111,631 | A | 5/1992 | Flood et al. |
| 5,115,623 | A | 5/1992 | Ahlberg |
| 5,123,550 | A | 6/1992 | Nodskov et al. |
| 5,125,205 | A | 6/1992 | Wichman |
| 5,161,344 | A | 11/1992 | Kahonen |
| 5,203,126 | A | 4/1993 | Sorenson et al. |
| 5,203,134 | A | 4/1993 | Sorenson et al. |
| 5,269,112 | A | 12/1993 | Weinrub et al. |
| 5,327,700 | A | 7/1994 | Sorenson et al. |
| 5,347,737 | A | 9/1994 | Theobald, III |
| 5,351,843 | A | 10/1994 | Wichman et al. |
| 5,438,780 | A | 8/1995 | Winner |
| 5,501,051 | A | 3/1996 | Harlan |
| 5,581,401 | A | 12/1996 | Takamoto et al. |
| 5,671,579 | A | 9/1997 | Camino et al. |
| 5,706,130 | A | 1/1998 | Rosen |
| 5,743,037 | A | 4/1998 | Martin |
| 5,826,397 | A | 10/1998 | Armold |
| 5,829,178 | A | 11/1998 | Hillstrom |
| 5,983,545 | A | 11/1999 | Marco |
| 6,012,688 | A | 1/2000 | LaMotte |
| 6,046,845 | A | 4/2000 | Niwa et al. |
| 6,052,227 | A | 4/2000 | Niwa et al. |
| 6,052,950 | A | 4/2000 | Wendel |
| 6,092,770 | A | 7/2000 | Battocchio |
| 6,191,886 | B1 | 2/2001 | Sinkoff |
| 6,227,753 | B1 | 5/2001 | Boer |

OTHER PUBLICATIONS

"Smart Displays www.smartsystemdisplay.com 8'Smart Fabric", brochure from Smart Display, 3 pages, date unknown.

"BigFabric Pop-Up Displays" from Impact Displays, Inc.'s website; Apr. 11, 2002; two pages.

"Big Fabric Pop-up Portable Display" from website of RainmakerDisplay.com; Jul. 10, 2002, 1 page.

"Bannerslands" from bannerimp.com website; Jul. 10, 2002; 1 page.

PROJECTION SCREEN APPARATUS

BACKGROUND AND SUMMARY OF THE INVENTION

The present invention relates to projection screens. More particularly, the present invention relates to portable projection screens.

According to the present invention, a collapsible display apparatus is provided for use with a projector configured to project an image to be watched by a viewer. The collapsible display apparatus includes a support frame moveable between a collapsed position and an expanded position, a white projection screen, a back sheet, and a lock. The support frame includes a plurality of frame member pairs and a plurality of hubs. Each frame member pair includes first and second frame members pivotably coupled together to define an X-shape. Each first and second frame member is pivotably coupled to the plurality of hubs to permit movement of the support frame between the collapsed and expanded positions. The projection screen is substantially blank, supported by the support frame, and made of a polyester fabric. The back sheet is positioned between the projection screen and the support frame to protect the projection screen from damage during movement of the support frame to the collapsed position. The lock is positioned to block movement of the support frame between the expanded and collapsed positions. The lock includes a first telescope member, a second telescope member positioned in the first telescope member, and a lock member configured to selectively block relative movement between the first and second telescope members. The second telescope member is positioned in the first telescope member when the support frame is in the collapsed position.

According to another aspect of the present invention, a collapsible display apparatus is provided including a support frame and a white projection screen. The support frame is moveable between a collapsed position and an expanded position. The support frame includes a plurality of frame member pairs and a plurality of hubs. Each frame member pair includes first and second frame members pivotably coupled together to define an X-shape. Each first and second frame member is pivotably coupled to the plurality of hubs to permit movement of the support frame between the collapsed and expanded positions. The projection screen is blank, supported by the support frame, and made of a polyester fabric.

According to another aspect of the present disclosure, a collapsible display apparatus is provided including a support frame, a projection screen, and a back sheet. The support frame is moveable between a collapsed position and an expanded position. The support frame includes a plurality of frame member pairs and a plurality of hubs. Each frame member pair includes first and second frame members pivotably coupled together to define an X-shape. Each first and second frame member is pivotably coupled to the plurality of hubs to permit movement of the support frame between the collapsed and expanded positions. The projection screen is supported by the support frame. The back sheet is positioned between the projection screen and the support frame to protect the projection screen from damage during movement of the support frame to the collapsed position.

According to another aspect of the present disclosure, a collapsible display apparatus is provided including a support frame, a display sheet, and a lock. The support frame is moveable between a collapsed position and an expanded position. The support frame includes a plurality of frame member pairs and a plurality of hubs. Each frame member pair includes first and second frame members pivotably coupled together to define an X-shape. Each first and second frame member is pivotably coupled to the plurality of hubs to permit movement of the support frame between the collapsed and expanded positions. The display sheet is supported by the support frame. The lock is positioned to block movement of the support frame between the expanded and collapsed positions. The lock includes a first telescope member, a second telescope member positioned in the first telescope member, and a lock member configured to selectively block relative movement between the first and second telescope members. The second telescope member is positioned in the first telescope member when the support frame is in the collapsed position.

According to another aspect of the present invention, a collapsible display apparatus is provided including a display sheet and a support frame supporting the display sheet. The support frame is moveable between a collapsed position and an expanded position. The support frame includes a plurality of frame member pairs and a plurality of hubs. Each frame member pair includes first and second frame members pivotably coupled together to define an X-shape. Each first and second frame member is pivotably coupled to the plurality of hubs to permit movement of the support frame between the collapsed and expanded positions. At least one of the first and second frame members has at least one substantially flat sidewall.

According to another aspect of the present invention, a collapsible display apparatus is provided including a display sheet and a support frame supporting the display sheet. The support frame is moveable between a collapsed position and an expanded position. The support frame includes a plurality of frame member pairs and a plurality of hubs. Each frame member pair includes first and second frame members pivotably coupled together by a pin to define an X-shape. Each first and second frame member is pivotably coupled to the plurality of hubs to permit movement of the support frame between the collapsed and expanded positions. Each of the first and second frame members has a depression defined in an outer surface of the frame members to align a tool adapted to form an aperture in the first and second frames to receive the pin.

According to another aspect of the present invention, a collapsible display apparatus is provided including a support frame, a white projection screen, and a border sheet. The support frame is moveable between a collapsed position and an expanded position. The support frame includes a plurality of frame member pairs and a plurality of hubs. Each frame member pair includes first and second frame members pivotably coupled together to define an X-shape. Each first and second frame member is pivotably coupled to the plurality of hubs to permit movement of the support frame between the collapsed and expanded positions. The projection screen is supported by the support frame. The border sheet is positioned around the projection screen to frame the projection screen and define a perimeter of a viewing surface of the projection screen.

According to another aspect of the present invention, a collapsible display apparatus is provided including a support frame, a display sheet, and a plurality of fasteners. The support frame has a front side, a first end, a second end, and a back side. The support frame is moveable between a collapsed position and an expanded position. The support frame includes a plurality of frame member pairs and a plurality of hubs. Each frame member pair includes first and second frame members pivotably coupled together to define an X-shape. Each first and second frame member is pivotably coupled to the plurality of hubs to permit movement of the support frame between the collapsed and expanded positions. The display sheet is supported on the support frame. The display sheet includes a front panel positioned on the front side of the support frame and a pair of side panels extending along the first and second ends. The side panels includes a plurality of fastener-receiving openings. The plurality of fasteners extend through the fastener-receiving openings to couple the side panels to the support frame.

According to another aspect of the present disclosure, a collapsible display apparatus is provided including a support frame and a blank, white projection screen detachably coupled to the support frame. The support frame is moveable between a collapsed position and an expanded position. The support frame includes a plurality of frame member pairs and a plurality of hubs. Each frame member pair includes first and second frame members pivotably coupled together to define an X-shape. Each first and second frame member is pivotably coupled to the plurality of hubs to permit movement of the support frame between the collapsed and expanded positions.

Additional features of the present invention will become apparent to those skilled in the art upon consideration of the following detailed description of an illustrated embodiment exemplifying the best mode of carrying out the invention as presently perceived.

BRIEF DESCRIPTION OF THE DRAWINGS

A detailed description particularly refers to the accompanying figures in which.

DETAILED DESCRIPTION OF THE DRAWINGS

Figure 1:
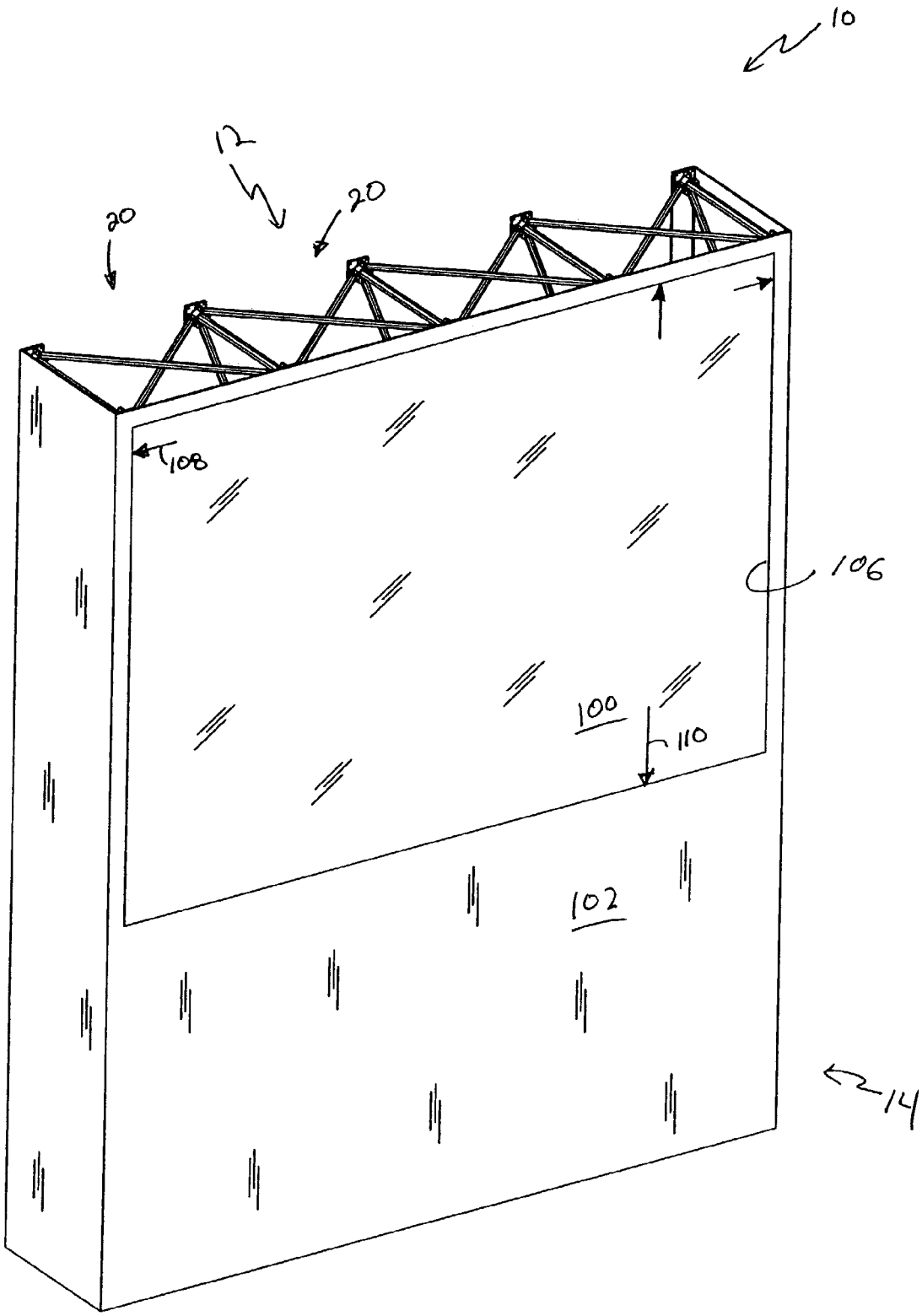
FIG. 1 is a perspective view of a collapsible display apparatus according to the present disclosure showing the apparatus in an expanded position and including a detachable display sheet and a support frame supporting the display sheet.
Figure 2:
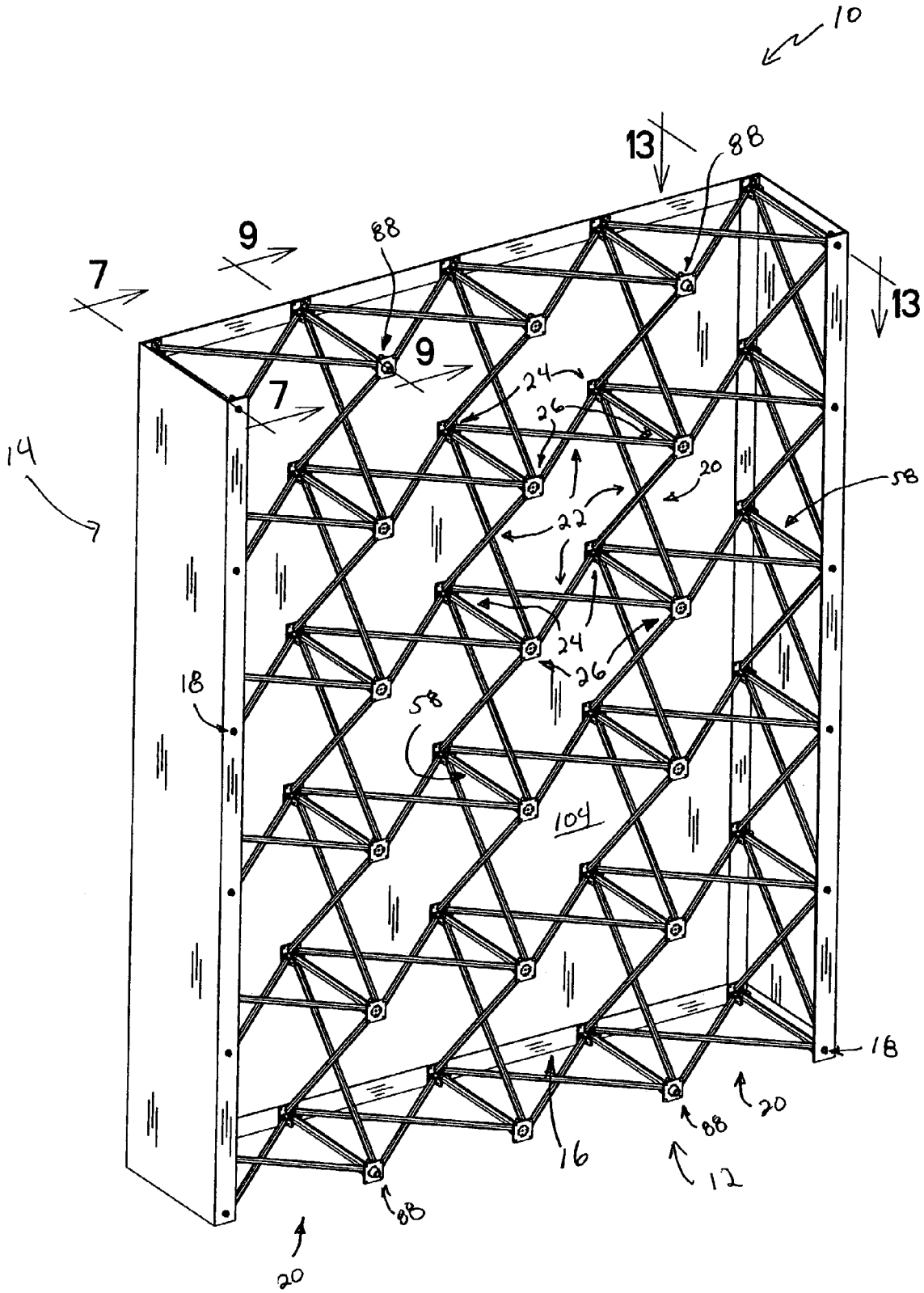
FIG. 2 is a rear perspective view of the collapsible display apparatus of FIG. 1 showing the display sheet covering a front side and ends of the support frame and portions of a back side of the support frame.
Figure 3:
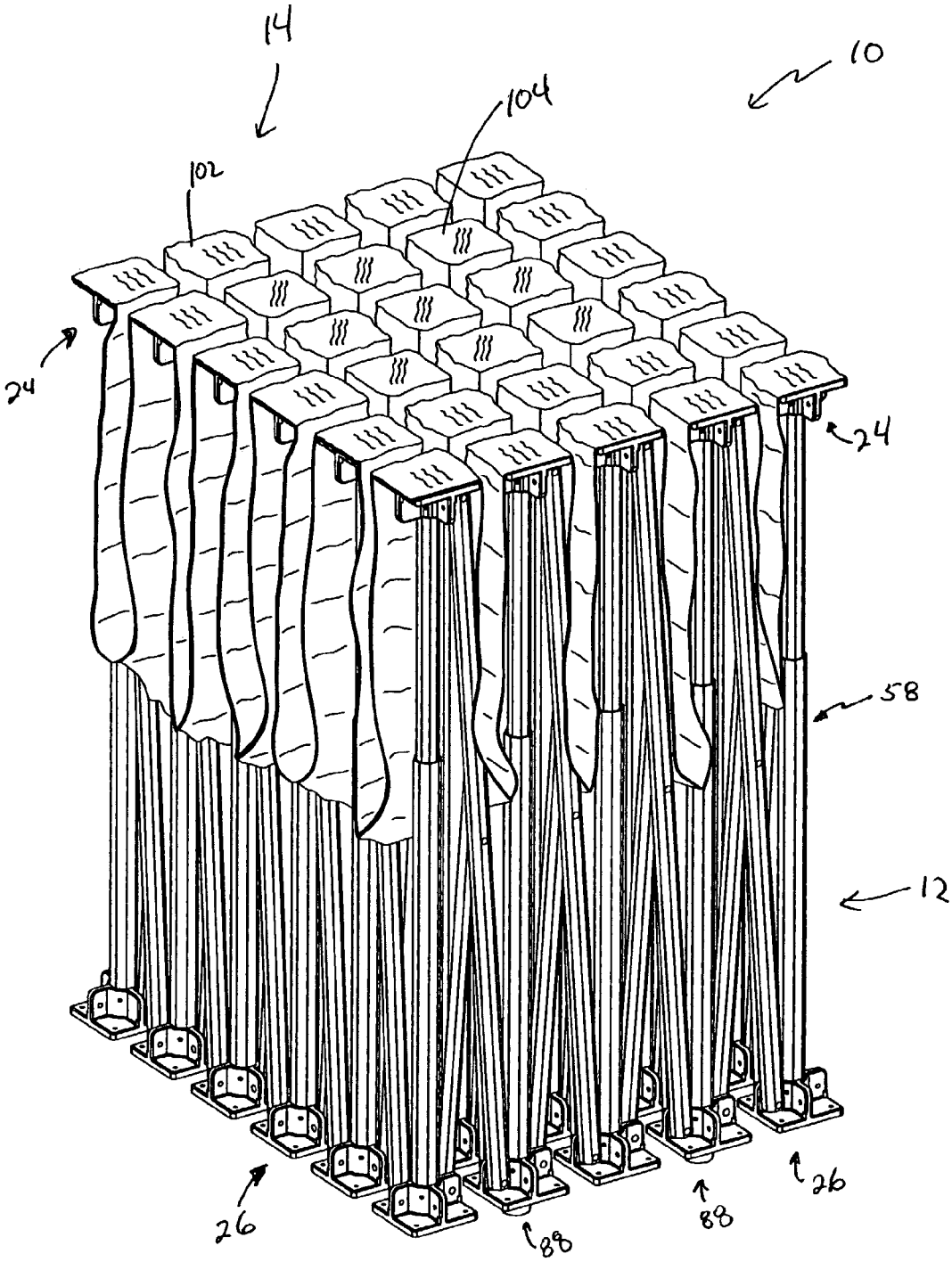
FIG. 3 is a perspective view of display apparatus of FIG. 1 showing the apparatus in a collapsed position with the display sheet tucked in the collapsed support frame.

According to the present disclosure, a projection screen apparatus 10 is provided to display images projected by a projector (not shown). Projection screen apparatus 10 is moveable between an expanded position, shown in FIGS. 1 and 2, and a collapsed position as shown in FIG. 3. To facilitate movement between the expanded and collapsed positions, apparatus 10 includes a collapsible support frame 12 that supports a display sheet 14.

Display sheet 14 is configured to reflect images projected by the projector back to an audience positioned in front of apparatus 10. Preferably, display sheet 14 remains attached to support frame 12 when collapsed as shown in FIG. 3. When support frame 12 is collapsed, it can be inserted into a bag (now shown), a hard shipping case (not shown), or other such container for storage or shipment.

Display sheet 14 is also removable from support frame 12 to permit display sheet 14 to be laundered, repaired, or replaced. Apparatus 10 includes a perimeter fastener 16, as shown in FIG. 2, that removably couples display sheet 14 to a front side of support frame 12. Apparatus 10 further includes a plurality of fasteners 18 coupled to a back side of support frame 12 that couples display sheet 14 to a back side of support frame 12 when it is in the expanded position as shown in FIG. 2.

Support frame 12 includes a plurality of sub frames 20 that are coupled together to form a matrix. According to the embodiment shown in FIG. 2, support frame 12 is four sub frames wide and five sub frames tall. According to alternative embodiments, other combinations of sub frames 20 are provided to support different sized display sheets.

Figure 8:
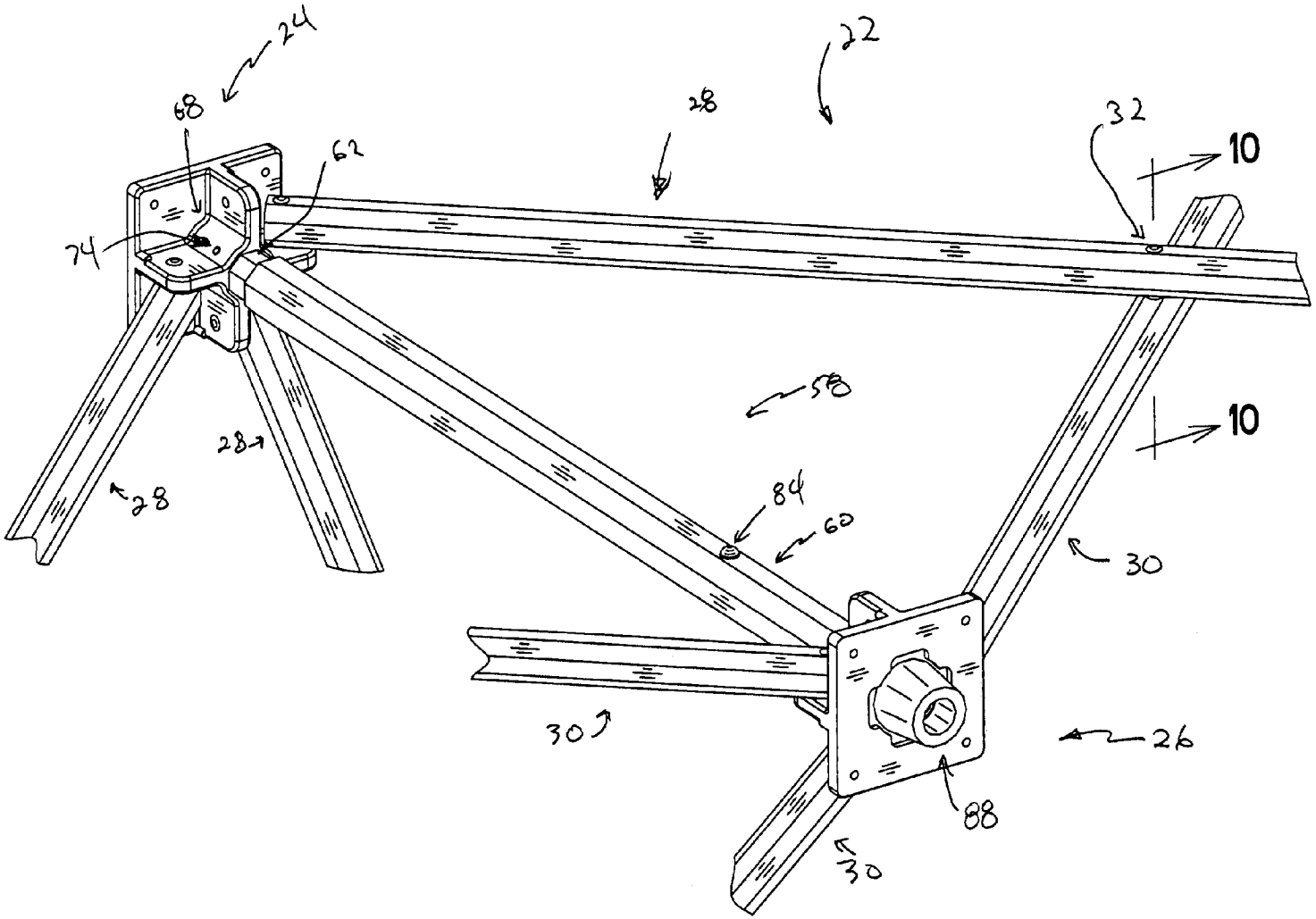
FIG. 8 is a perspective view of another portion of the support frame showing the support frame including a rubber foot coupled to one of the hubs and a pair of the frame members pivotably coupled together by a pin.

Sub frames 20 include four frame pairs 22, four front hubs 24, and four back hubs 26. Adjacent sub frames 20 share a frame pair 22, a pair of front hubs 24, and a pair of back hubs 26. Frame pairs 22 include first and second frame members 28, 30 that are pivotably coupled together by a pin 32, as shown in FIG. 8 and pivotably coupled to a front hub 24 and a back hub 26. Frame pairs 22 define an X-shape. Two frame pairs 22 of each sub frame 20 are positioned in a vertical orientation and the other two frame pairs 22 of a sub frame 20 are positioned in a horizontal orientation when apparatus 10 is set up for use as shown in FIG. 2. According to alternative embodiments of the present disclosure, other frame configurations are provided for use with display sheet 14, such as the frames shown in U.S. Pat. Nos. 4,471,548; 4,512,097; 4,580,375; 4,800,663; 4,809,471; 4,888,895; 4,986,016; 5,123,550; 5,125,205; 5,203,126; 5,269,112; 5,826,397, or other such frames known to those of ordinary skill in the art. The disclosures of these patents are expressly incorporated by reference herein.

Figure 10:
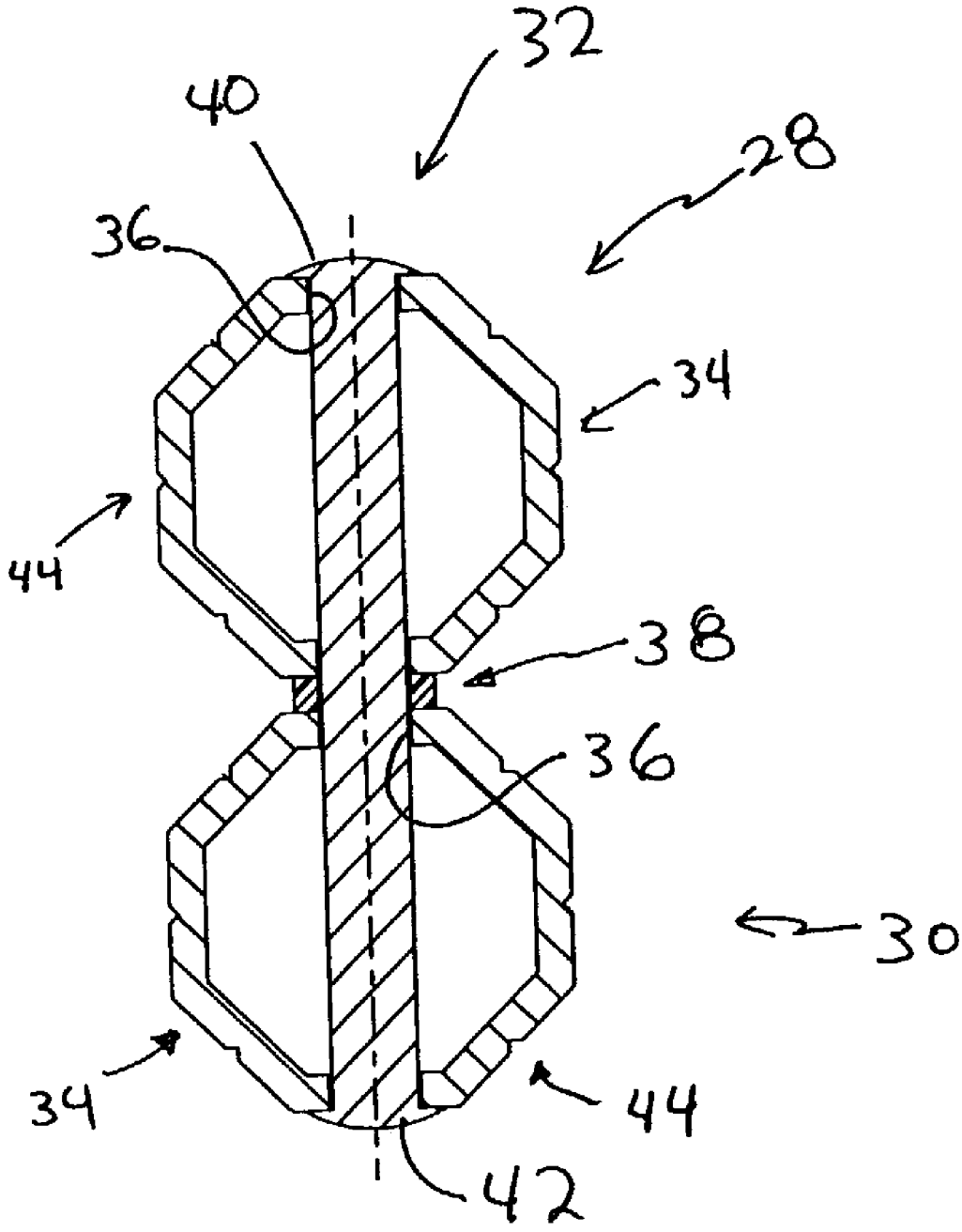
FIG. 10 is a cross-sectional taken along line 10—10 of FIG. 8 showing the frame members pivotably coupled together by the pin.

Frame members 28, 30 have substantially flat side walls 34 as shown in FIG. 10. According to the preferred embodiment, frame members 28, 30 are octagonal and made of extruded aluminum. According to alternative embodiments of the present disclosure, other sidewall configurations are provided such as round, triangular, square, rectangular, hexagonal, or other such shapes known to those of ordinary skill in the art.

Each frame member 28 includes a pair of apertures 36 sized to receive pin 32. A washer 38 is positioned between two flat side walls 34 of first and second frame members 28, 30. During assembly, pin 32 is positioned through apertures 36 with flat head 40 positioned above first member 28. Then the lower end of pin 32 is clinched to form lower flat head 42.

To facility forming of apertures 36 in first and second frame members 28, 30, flat side walls 34 are provided with centered depressions 44 in each of the eight side walls 34. Depressions 44 are preferably V-shaped and extend the entire length of each frame member 28, 30. To form apertures 36, a tool (not shown), such as a drill bit, is positioned in depression 44 at the appropriate axial position along either frame member 28, 30. By positioning the bit in depression 44, the respective aperture 36 formed by the bit will be centered in the respective sidewall 34 because depression 44 is centered in the respective sidewall. For clarity in the figures, depressions 44 are only shown in FIG. 10, but would otherwise be visible in the other figures.

As previously mentioned, each end of frame members 28, 30 is pivotably coupled to a respective hub 24, 26. Using depressions 44 in sidewalls 34, apertures 46 are formed in each end of frame members 28, 30 for receiving a pin 48 that pivotably couples the ends of frame members 28, 30 to hubs 24, 26 as shown in FIG. 6.

Each of hubs 24, 26 is made of ABS plastic and includes a base 50 and four ribs 52 that extends perpendicular to base 50. Each rib 52 is slightly off set from the center of base 50 so that opposite ribs 52 do not line up. Ribs 52 include apertures 54 sized to receive a respective pin 48 that couples a frame member 28, 30 thereto.

Figure 6:
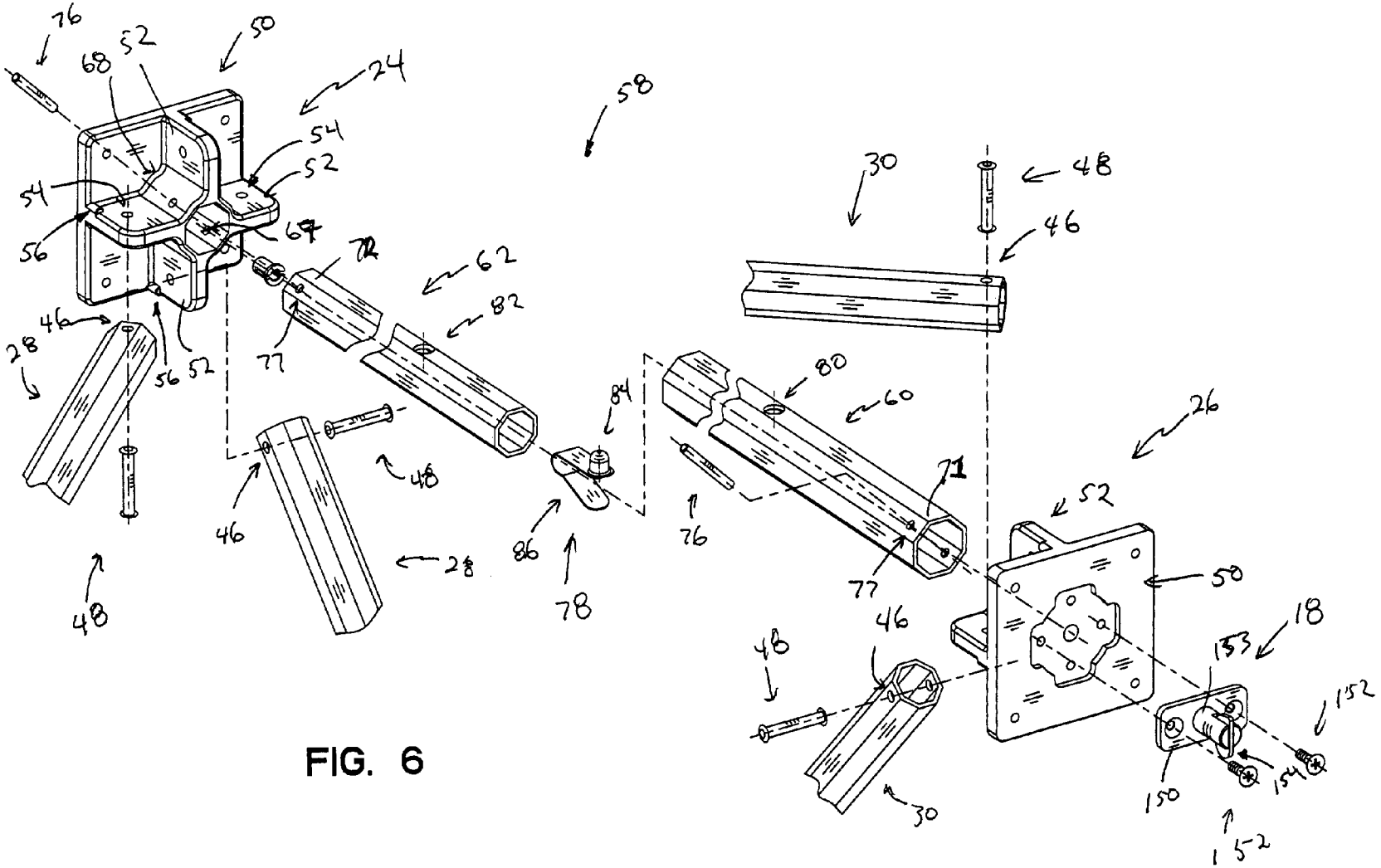
FIG. 6 is an exploded assembly view of the portions of the support frame shown in FIG. 4.

Each rib 52 further includes an indicator 56, shown in FIG. 6, that indicates which side of rib 52 the respective frame member 28, 30 is to be positioned. Indicator 56 is a bump or raised portion positioned on one side of each rib 52. The opposite side of rib 52 is devoid of such a bump 56. During assembly, the respective frame member 28, 30 should be positioned on the side of the respective rib 52 without indicator 56. If a frame member 28, 30 is positioned on the side of a rib 52 with an indicator 56, the respective indicator 56 will block the respective frame member 28, 30 from touching the respective rib 52 and not permit pin 48 to be clinched. Thus, indictors 52 indicate which side of rib 52 the respective frame member 28, 30 is to be positioned and blocks coupling of the respective frame member 28, 30 to the wrong side of a rib 52.

To hold frame 12 in the expanded position, support frame 12 includes a plurality of locks 58. During expansion and collapsing of support frame 12, first and second frame members 28, 30 and front and back hubs 24, 26 move relative to one another. For example, during expansion, front and back hubs 24, 26 move toward one another. Locks 58 are positioned between respective front and back hubs 24, 26 to prevent such movement and thus block frame 12 from collapsing. According to alternative embodiments of the present disclosure, locks 58 are positioned between other components of the frame to block relative movement. For example, according to one embodiment, locks are positioned between frame members to block relative movement. According to another embodiment, locks are provided between the hubs and frame members to block relative movement. According to other alternative embodiments of the present disclosure, other locks known to those of ordinary skill in the art are provides for use with frame 12 and/or display sheet 14 such as the locks disclosed in the previously-mentioned U.S. patents.

Figure 4:
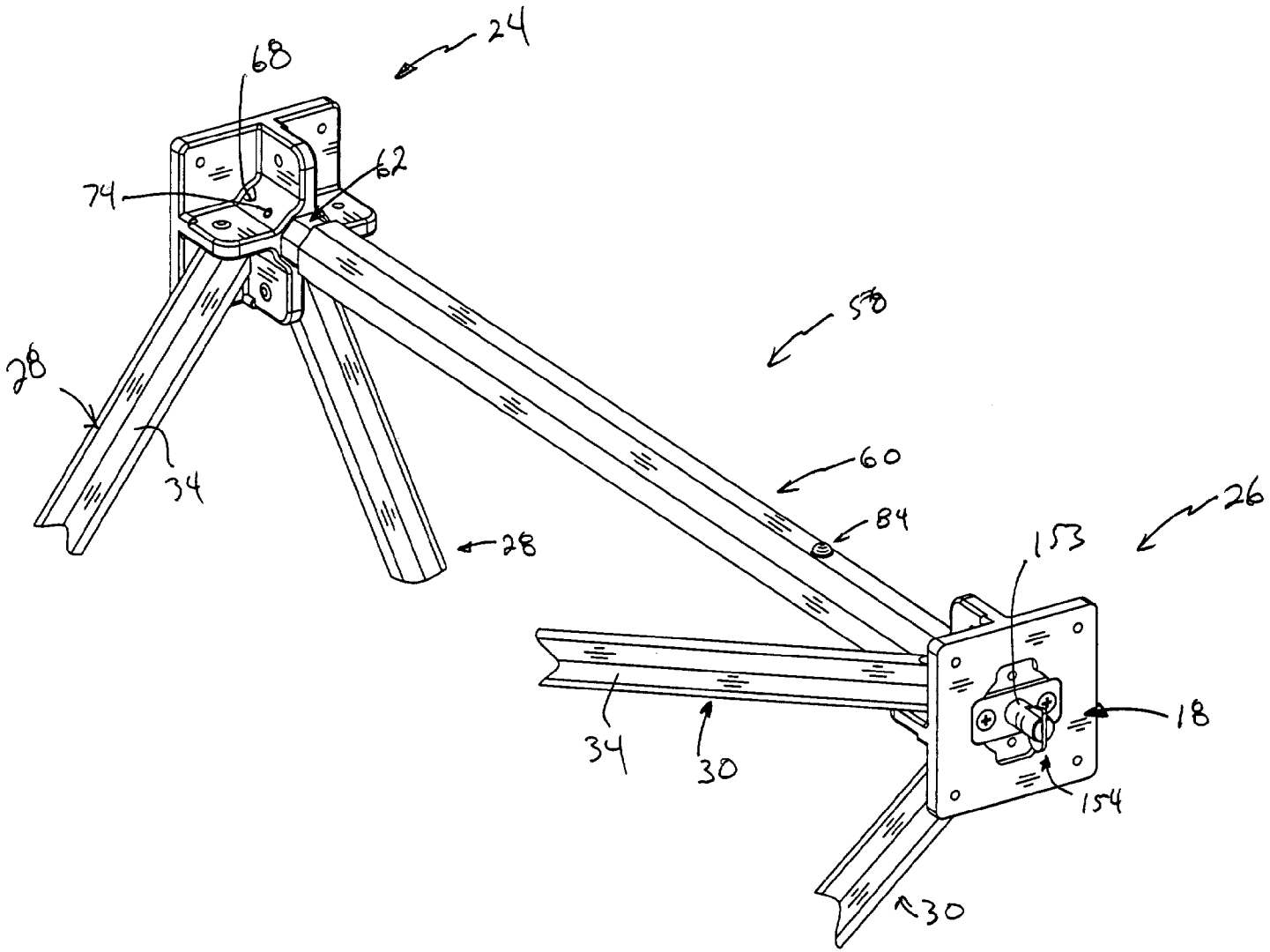
FIG. 4 is a perspective view of a portion of the support frame showing the support frame including a plurality of hubs, a plurality of frame members pivotably coupled to the hubs, and a telescoping lock coupled to the hubs and configured to lock the support frame in the expanded position.
Figure 5:
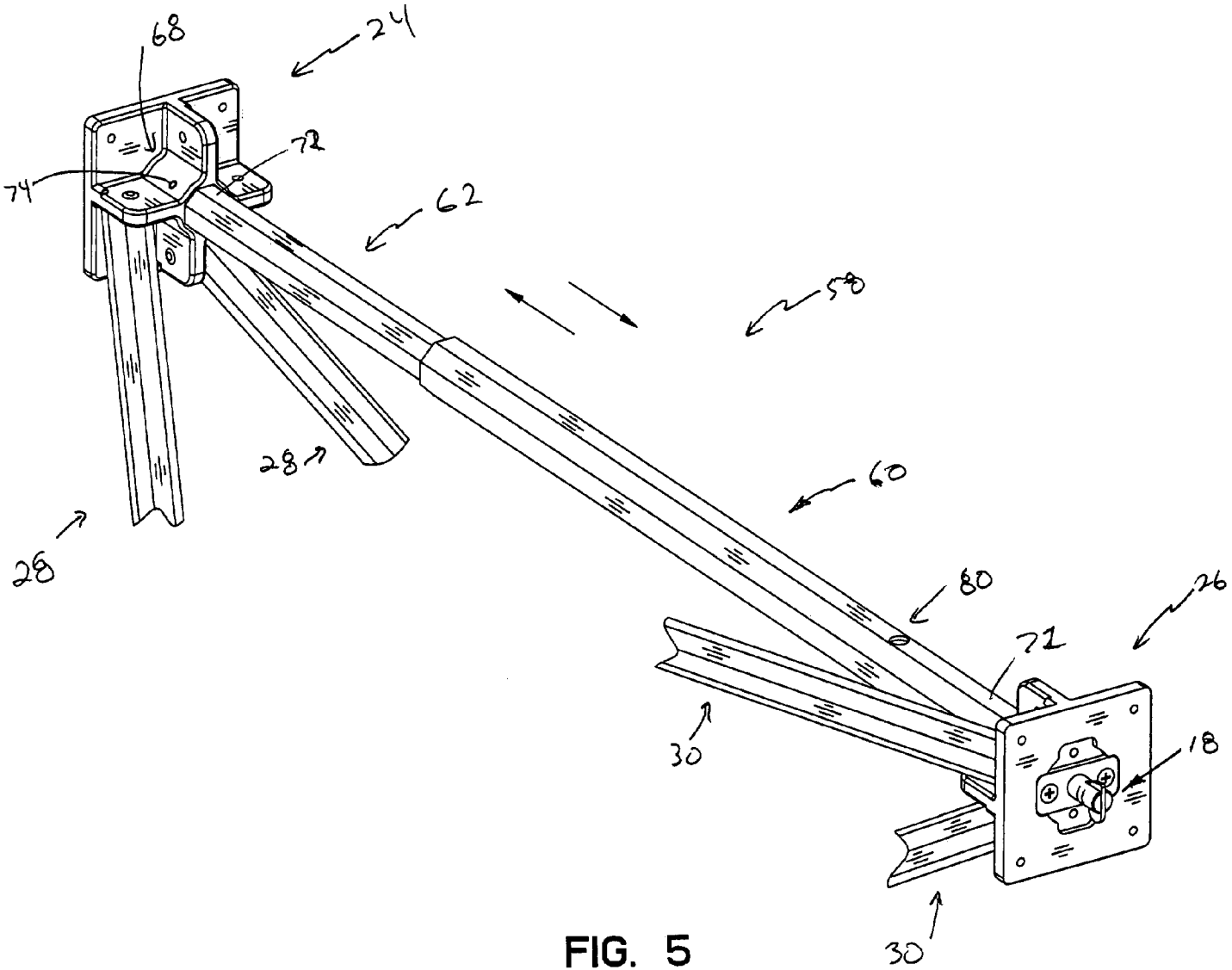
FIG. 5 is a view similar to FIG. 4 during movement of the support frame to the collapsed position showing the lock including a first telescope member and a second telescope member sliding in the first telescope member.
Figure 7:
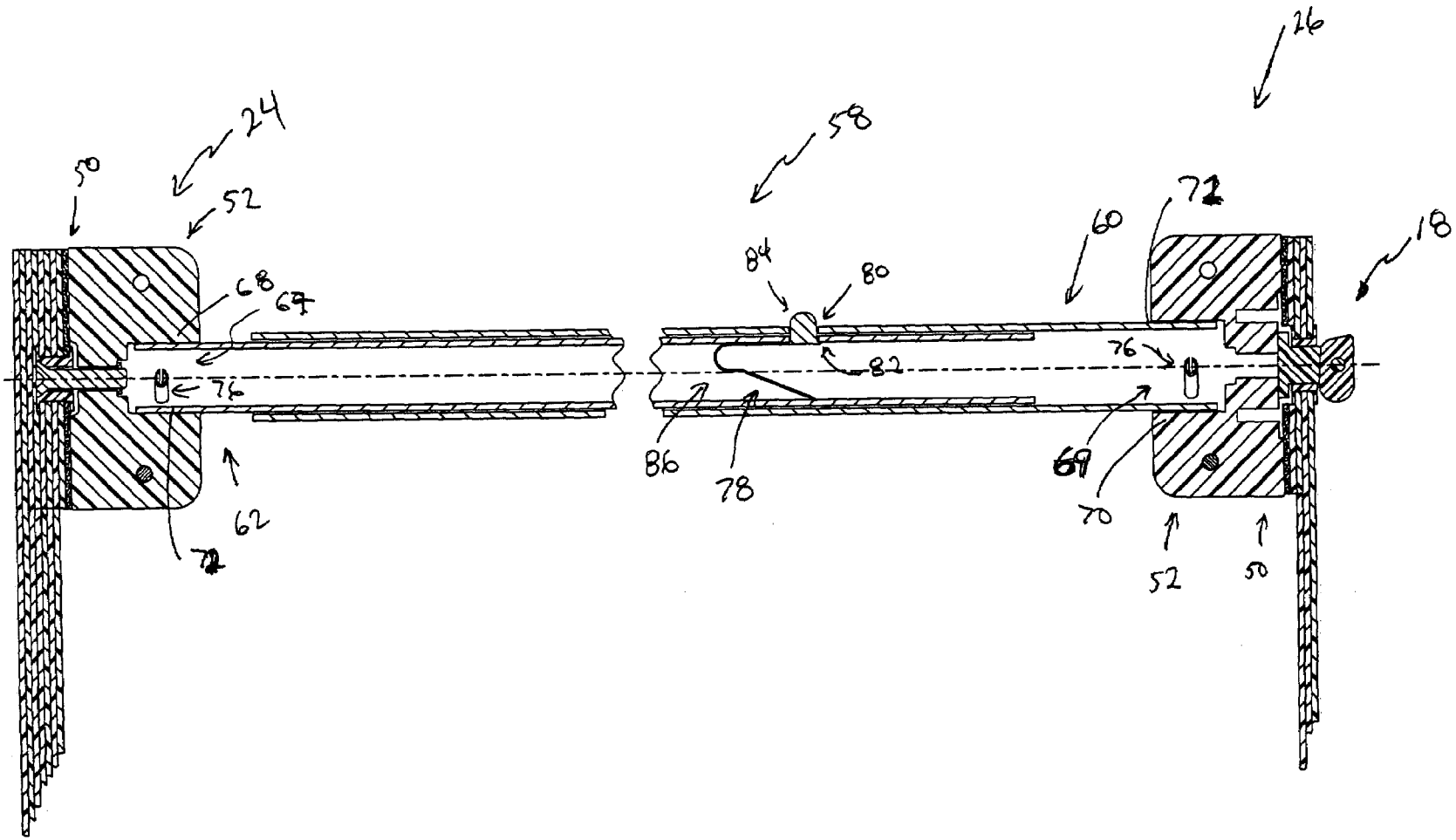
FIG. 7 is a cross-sectional view taken along line 7—7 of FIG. 2 showing the second telescope member positioned in the first telescope member and showing a lock member positioned in the first and second telescope members to lock the relative position of the first and second telescope members.

Each lock 58 includes a first telescope member 60 coupled to one of back hubs 26 and a second telescope member 62 positioned in first telescope member 60 and coupled to one of front hubs 24 as shown in FIGS. 4, 5, and 7. Each telescope member 60, 62 is octagonal having substantially flat sidewalls 64, 66 and depressions (not shown) similar to depressions 44 formed in first and second frame members 28, 30. Furthermore, second telescope member 62 is made from the same extrusion as first and second frame members 28, 30. First telescope member 60 is also made of extruded aluminum.

Front and back hubs 24, 26 include centered sleeve 68, 70 having apertures 67, 69 sized to receive ends 71, 72 of respective first and second telescope members 60, 62. According to the preferred embodiment, aperture 71 of back hub 26 is slightly larger than aperture 69 of front hub 24 because first telescope member 60 is slightly larger than second telescope member 62. According to an alternative embodiment of the present disclosure, the front and back hubs are identical and include a sleeve having a stepped aperture sized to receive both the first and second telescope members. The inner portion of the sleeve has a smaller inside diameter to receive the second telescope member and the outer portion of the sleeve has a larger inside diameter to receive the first telescope member.

Each sleeve 68, 70 is coupled to the respective ribs 52 of hubs 24, 26 and includes a pair of apertures 74 sized to receive a slotted expansion pin 76. Similarly, ends 71, 72 of first and second telescope members 60, 62 includes apertures 77 sized to receive pin 76. During assembly, a pin 76 is inserted through apertures 74, 77 to couple telescope members 60, 62 to respective hubs 26, 24.

During expansion and collapsing of frame 12, second telescope member 62 slides within first telescope member 64. To block this relative movement and to prevent frame 12 from similar movement, a lock member 78 is provided. Each of telescope member 60, 62 includes an aperture 80, 82 sized to receive a tab 84 of lock member 78. Lock member 78 further includes a biaser 86 that urges tab 84 into apertures 80, 82. When frame 12 is in the expanded position, tab 84 is positioned in apertures 80, 82 and blocks relative movement of telescope members 60, 62. To unlock lock 58 and permit frame 12 to collapse, tab 84 is pushed inwardly against the bias of biaser 86 so that tab 84 is no longer positioned in aperture 80 of first telescope member 60 to permit relative movement between first and second telescope members 60, 62. When frame 12 is moved to the expanded position, apertures 80, 82 align and biaser 86 pushes tab 84 into aperture 80 to block relative movement of first and second telescope members 60, 62.

During collapsing and expanding of frame 12, each second telescope member 62 remains positioned in each respective first telescope member 64. Because the ends of second telescope member 62 are never exposed, they will not catch or snag display sheet 14.

As shown in FIG. 8, apparatus 10 further includes four rubber feet 88, coupled to four back hubs 26 as shown in FIG. 2. Feet 88 support frame 12 on the floor when frame 12 is in collapsed position as shown in FIG. 3.

Figure 9:
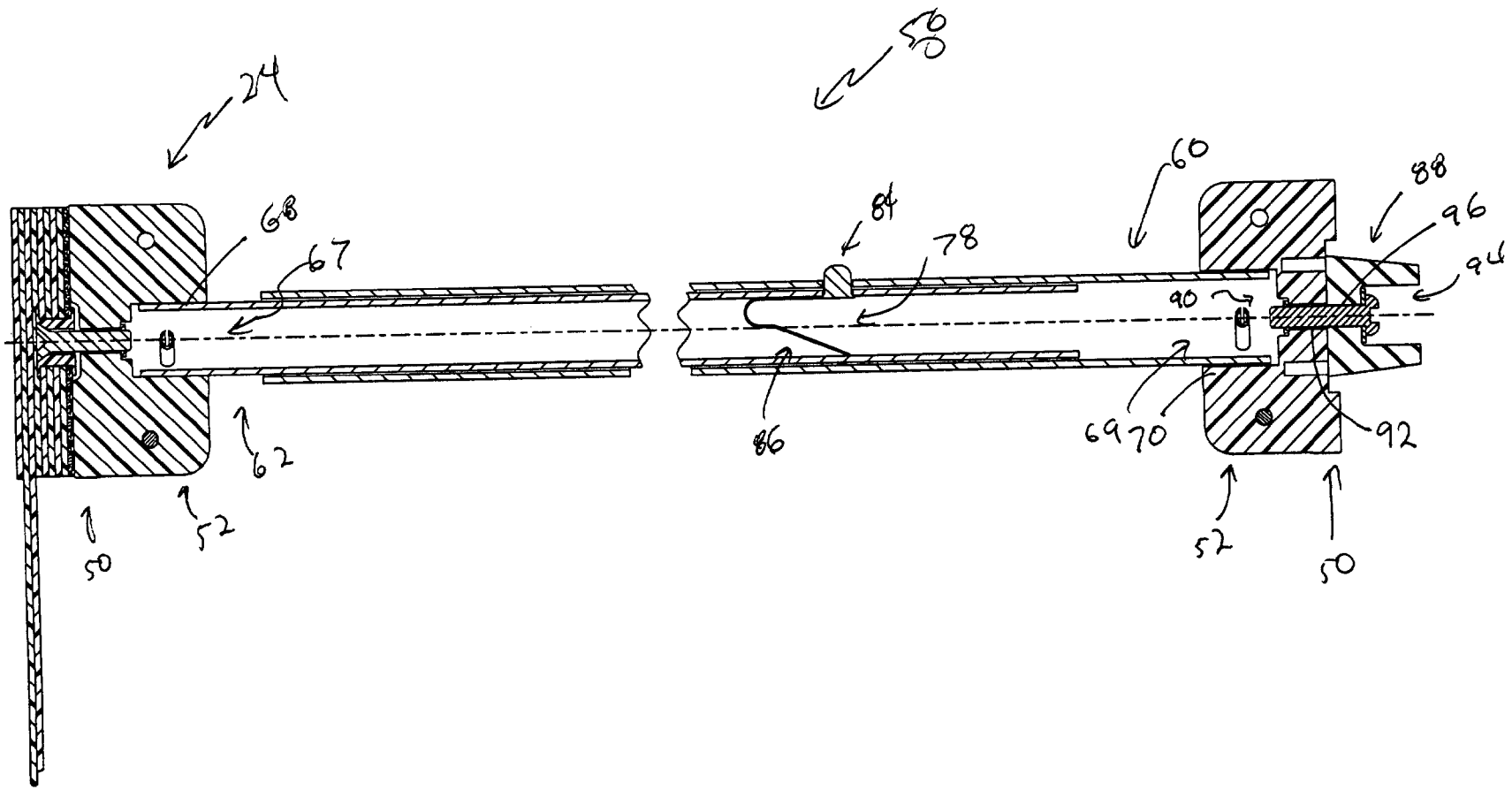
FIG. 9 is a cross-sectional view taken along line 9—9 of FIG. 2 showing the rubber foot coupled to one of the hubs.

As shown in FIG. 9, back hub 26 includes a nut-receiving aperture 90 sized to receive a brass expansion nut 92. During assembly, a bolt 94 is inserted through a fastener-receiving aperture 96 in foot 88 and turned into nut 92. As bolt 94 is turned further into nut 92, it expands and wedges into aperture 90 blocking removal of nut 92, bolt 94, and foot 88 from hub 26.

As previously mentioned, display sheet 14 is configured to reflect images projected from a projector. Display sheet 14 includes a projection screen 100, a front border sheet 102 positioned in front of projection screen 100, and a back sheet 104 positioned behind projection screen 100.

Projection screen 100 is made of white polyester fabric having a reflectivety gain of about 0.8. Screen 100 is substantially blank and free from text, graphics, or other printing or marking that would distort or detract from the images reflected by screen 100. According to alternative embodiments of the present disclosure, screen 100 or other layers of the display sheet includes printing, graphics, or other markings that are permanent displays or advertisements.

Preferably, projection screen 100 is made of a swiss pique construction having a weight of about 6.0 ounces/square foot. The polyester fabric makes projection screen 100 "wrinkle free" so that when display sheet 14 is tucked within voids defined by frame 12 during storage, projection screen 100 does not develop wrinkles that would otherwise detract from the image reflected by screen 100.

Front border sheet 102 and back sheet 104 are made of the same material type as projection screen 100. However, front border sheet 102 and back sheet 104 are made of black yarn. Preferably, the yarn is made of polyester that is dyed black so that the dye is integral with the polyester rather than applied to the surface of the polyester yarn before or after weaving. This prevents bleeding of the black dye during cleaning or laundering of display sheet 14. Because projection screen 100, front border sheet 102, and back sheet 104 are made of the same material type, they have the same expansion coefficient and same responses to environmental changes such as temperature, humidity, etc. so that wrinkles, puckers, and other imperfects are reduced due to environmental changes.

Border sheet 102, projection screen 100, and back sheet 104 are acoustically transparent. Thus, audio speakers (not shown) can be positioned within frame 12 or elsewhere behind display sheet 14 and the sound produced by the audio speakers will transmit through to the audience on the opposite side of projection screen 100.

Front border sheet 102 "frames" projection screen 100 and includes a rectangular opening 106 that defines a width 108 and height 110 of the viewing surface of projection screen 100. Projection screen 100 shown in FIG. 1 has a viewing surface with a width 108 of 80 inches and a height 110 of 100 inches. Front sheet 102 has a width of about 2 inches around the top and sides of screen 100 and height of about 42 inches below screen 100. According to alternative embodiments, screens having viewing surface areas (height by width) of 72 inches by 96 inches; 90 inches by 121 inches; 108 inches by 146 inches. According to alternative embodiments, other viewing surface sizes are provided.

Figure 13:
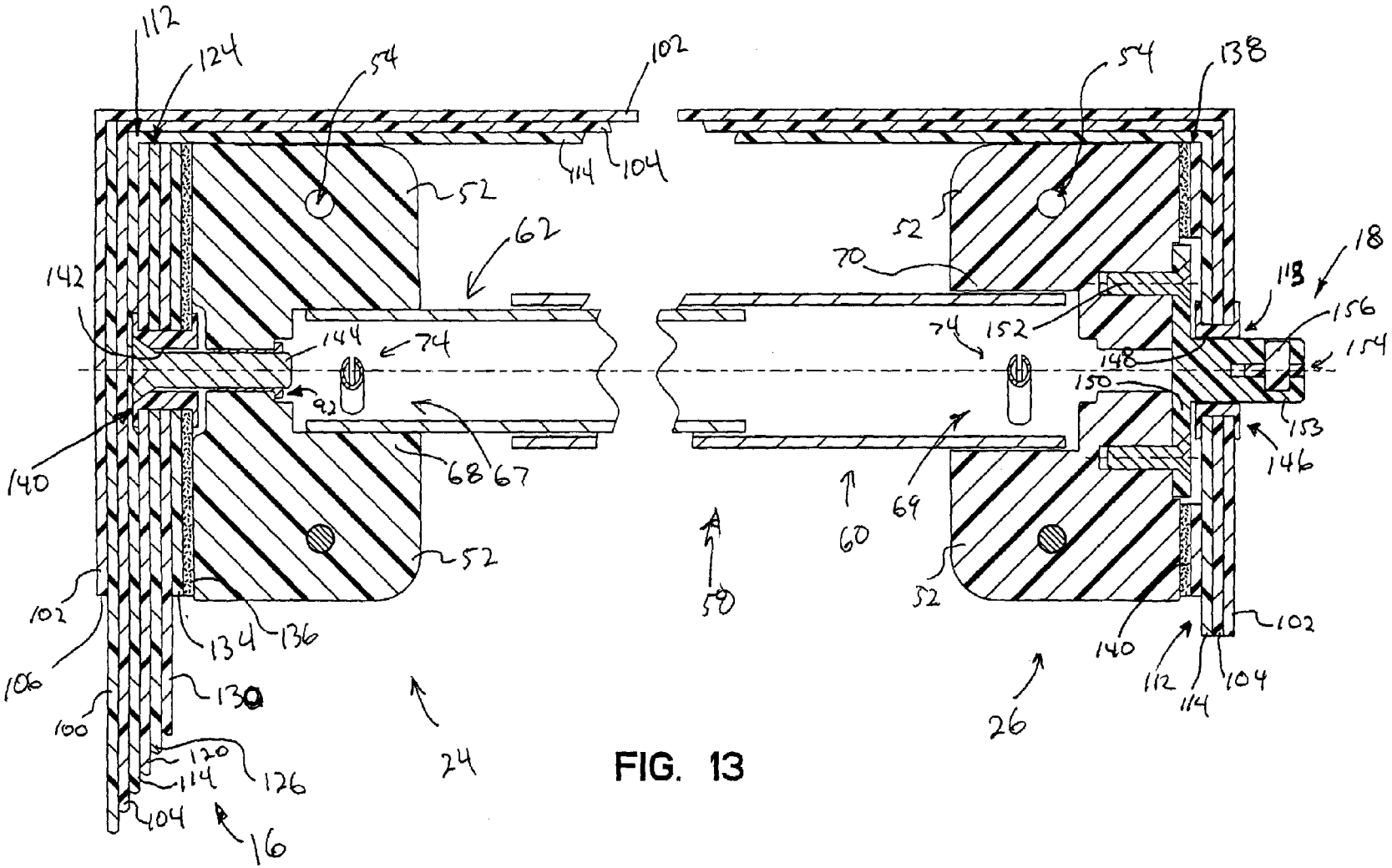
FIG. 13 is cross-sectional view taken along line 13—13 of FIG. 2 showing various layers of material of the display sheet.

Front sheet 102 and back sheet 104 extend from the top of frame 12 to the bottom of frame 12. Screen 100 extends from the top of frame 12 and terminates slightly below rectangular opening 106. As shown in FIG. 13, front sheet 102 and back sheet 104 wrap around the ends of frame 12 and extend around to the back of frame 12 before terminating. Screen 100 terminates at the ends of frame 12.

Figure 11:
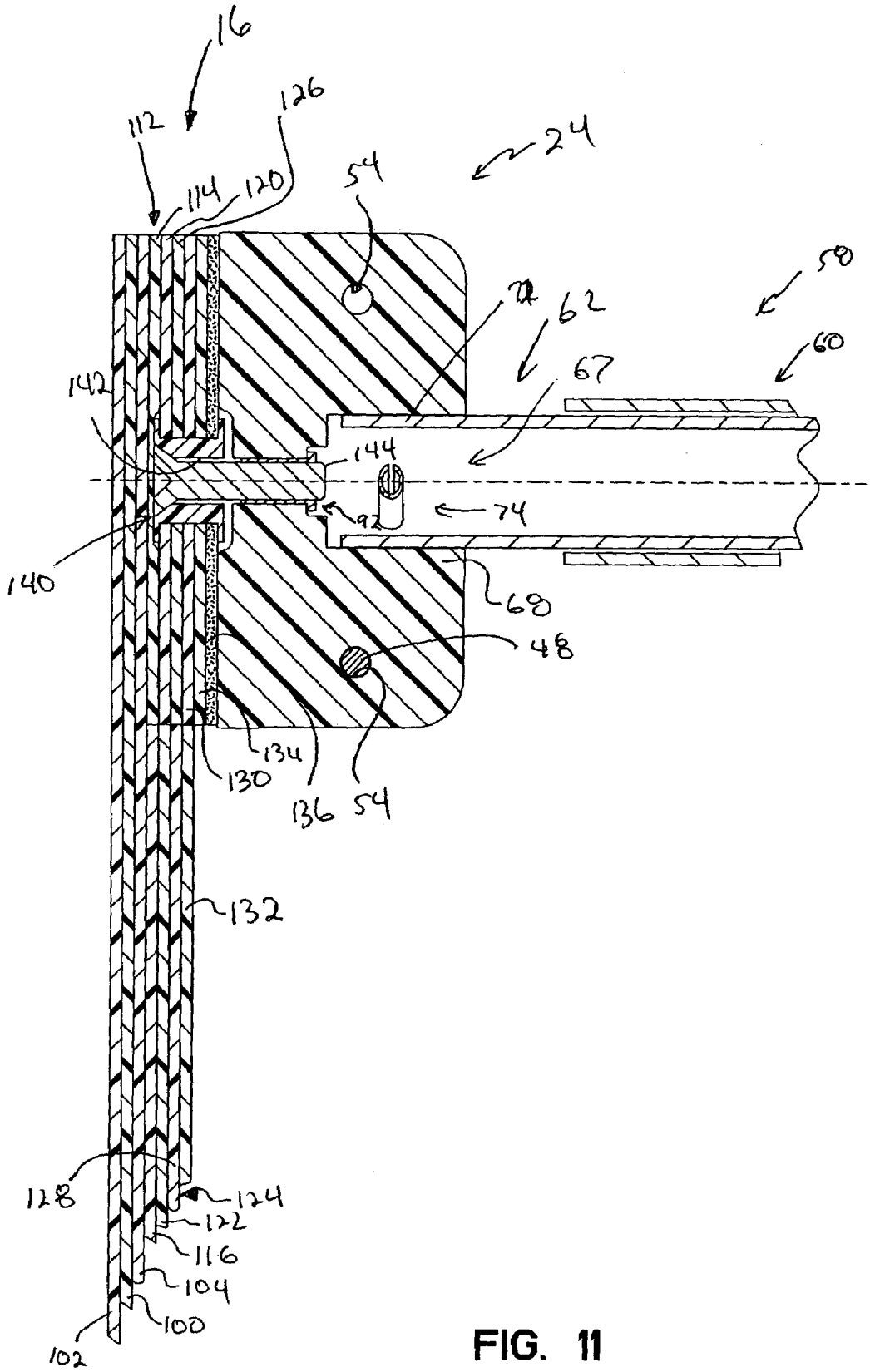
FIG. 11 is an enlarged view of a left portion of FIG. 7 showing various layers of material of the display sheet.
Figure 12:
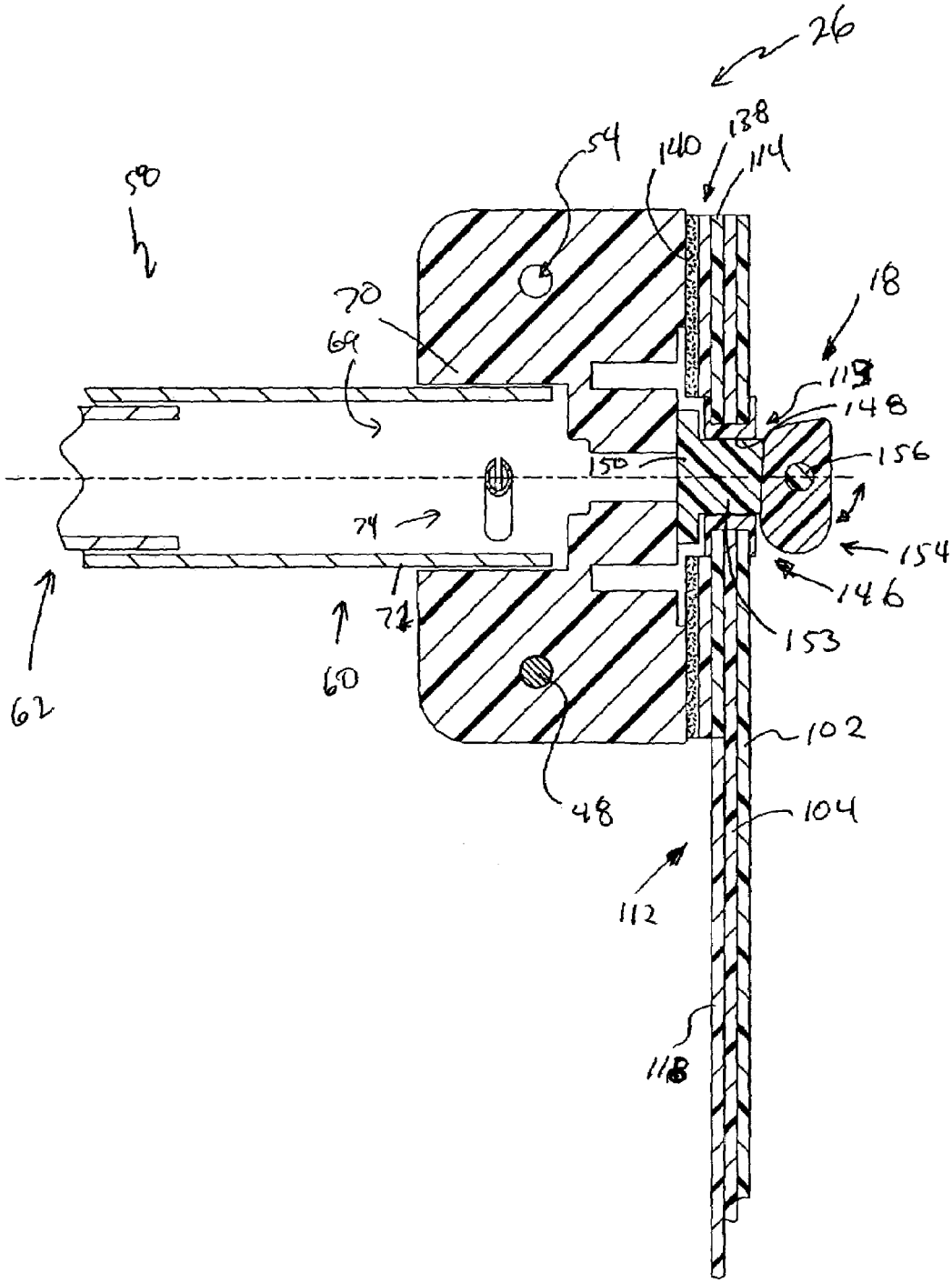
FIG. 12 is an enlarged view of a right portion of FIG. 7 showing various layers of material of the display sheet.

To attach display sheet 14 to frame 12, display sheet 14 includes a perimeter fastener 112 that corresponds to perimeter fastener 16 coupled to frame 12 and a plurality of apertures 113 that correspond to fasteners 18 coupled to the back of frame 12. As shown in FIGS. 11–13, perimeter fastener 112 includes a horizontal, two inch wide strip 114 of hook-and-loop type fasteners (also known as VELCRO-brand fasteners) that extends along the top of frame 12 from the back of frame 12 adjacent to one end of frame 12, along the respective end of frame 12, along the front of frame 12, along the opposite end of frame 12, and around to the back of frame 12 as partially shown in FIG. 13. An identical horizontal strip 114 is provided along the bottom of frame 12.

As shown in FIG. 11, a similar two inch vertical strip 116 of hook-and loop type fasteners is provided for perimeter fastener 112 along the front of frame 12 adjacent the bottom of upper horizontal strip 114. An identical vertical strip 116 is positioned at the opposite end on the front of frame 12. Horizontal strips 114 and vertical strips 116 cooperate to define a rectangular perimeter of hook-and-loop type fasteners along the front perimeter of frame 12.

Similar to vertical strips 116, two inch vertical strips 118 of hook-and-loop type fasteners are provided on the back of display sheet 14 as shown in FIG. 12. Vertical strips 118 extend from the top of bottom horizontal strip 114 to the bottom of top horizontal strip 114 as shown in FIG. 12.

Border sheet 102, screen 100, back sheet 104, and horizontal and vertical strips 114, 116 are permanently coupled together. Preferably, sheet 102, screen 100, sheet 104, and strips 114, 116 are sewn together along two rows that follow the perimeter of the front of frame 12. Additionally, border sheet 102, screen 100, and back sheet 104 are sewn together just below the bottom of rectangular opening 106. Border sheet 102, back sheet 104, and horizontal strips 114 are sewn together along ends and back of frame 12. Similarly, border sheet 102, back sheet 104, and vertical strips 118 are sewn together from top to bottom.

Perimeter fastener 16 includes horizontal and vertical strips 120, 122 of hook-and-loop type fasteners that correspond to horizontal and vertical strips 114, 116 of perimeter fastener 112. Horizontal and vertical strips 120, 122 define a rectangular perimeter of hook-and-loop type fasteners along the front of frame 12.

Perimeter fastener 16 further includes a rectangular flexible frame 124 behind horizontal and vertical strips 120, 122. Flexible frame or webbing 124 is made of polypropylene webbing. Webbing 124 provides a rectangular frame work between front hubs 24 to keep the front perimeter of display sheet 14 taut. Webbing 124 include a pair of horizontal strips 126 and a pair of vertical strips 128 similar to horizontal and vertical strips 120, 122 but does not extend around the ends to the back of frame 12.

Perimeter fastener 16 further includes a pair of horizontal strips 130 of hook-and-loop type fasteners and a pair of vertical strips 132 of hook-and-loop type fasteners that correspond to horizontal and vertical strips 126, 128. A two-inch square 134 of hook-and-loop type fastener is provided for each perimeter front hub 24. Squares 134 include an adhesive backing 136 that is coupled to each respective front hub 24. Similarly a two-inch square 138 of hook-and-loop type fastener is provided for each back hub 26 positioned along the ends of frame 12. Squares 138 include an adhesive backing 140 that is coupled to each respective back hub 26. Squares 136 couple with horizontal and vertical strips 130, 132.

Respective horizontal and vertical strips 120, 122, webbing 124, respective horizontal and vertical strips 130, 132, and squares 134 are coupled together with plastic grommets 140 as shown in FIG. 13. Each grommet 140 includes an aperture 142 through which a fastener 144, such as a pan screw, is inserted and turned into an expansion nut 92 to couple fastener 16 to each respective front hub 24. Squares 136 prevent the respective portions of perimeter fastener 16 from rotating about respective fasteners 144.

Border sheet 102, back sheet 104, and horizontal strip 144 are coupled together with plastic grommets 146 as shown in FIG. 12. Each grommet 146 includes an aperture 148 through which one of fasteners 18 is inserted to couple the back of display sheet 14 to each respective back hub 26. Squares 138 prevent the respective portions of perimeter display sheet 14 from rotating about respective fasteners 18.

Fasteners 18 includes a base 150 coupled to back hub 26 by a pair of screws 152, shown in FIG. 6, a post 153, and a cross member 154 pivotably coupled to post 153 by a pin 156. To couple display sheet 14 to one of fasteners 18, cross member 154 is rotated until it is aligned with post 153. Aligned cross member 154 is inserted through aperture 148 of grommet 146. Cross member 154 is released and moves to a position substantially perpendicular to post 152 as shown in FIGS. 4 and 12. When in this position, cross member 154 blocks removal of grommet 146 from fastener 18 and frame 12.

To remove display sheet 14 from fasteners 18, cross member 154 is aligned with post 152 so that grommet 146 can be removed from post 152 with cross member 154 blocking such removal. Once display sheet 14 is removed from fasteners 18, frame 12 is collapsed by unlocking locks 58. When frame 12 is collapsed, display sheet 12 is tucked into the voids created in frame 12 as shown in FIG. 3. In FIG. 3, the ends of display sheet 14 are shown folded forward over the front of display sheet 14 to show details of frame 12.

If necessary or on a periodic basis, display sheet 14 can be completely removed from frame 12. Display sheet 14 is first removed from fasteners 18 as described above. Next, display sheet 14 is removed from frame 12 by peeling perimeter fastener 112 of display sheet 14 from perimeter fastener 16 so that the hook-and-loop type fasteners uncouple. Then, display sheet 14 can be laundered, repaired, or replaced if necessary.

To couple display sheet 14 back on frame 12, perimeter fastener 112 of display sheet 12 is positioned back over perimeter fastener 16 and display sheet 14 is coupled to fasteners 18 positioned on back of frame 12, if necessary.

Preferably, instructions for the assembly, installation, and/or use of projection screen apparatus 10 are provided with projection screen apparatus 10 or otherwise communicated to permit a person or machine to assemble, install and/or use projection screen apparatus 10. Such instructions may include a description of any or all portions of projection screen apparatus 10 and/or any or all of the above-described assembly, installation, and use of projection screen apparatus 10 or components of projection screen apparatus 10. The instructions may be provided on separate papers and/or on the packaging in which projection screen apparatus 10 is sold or shipped. These instructions may also be provided over the Internet or other communication system. Furthermore, the instructions may be embodied as text, pictures, audio, video, or any other medium or method of communicating instructions known to those of ordinary skill in the art.

Unless otherwise stated herein, the figures are proportional. Although the present invention has been described in detail with reference to preferred embodiments, variations and modifications exist within the scope and spirit of the present invention as described and defined in the following claims.

What is claimed is:

1. A collapsible display apparatus for use with a projector configured to project an image to be watched by a viewer, the collapsible display apparatus comprising a support frame moveable between a collapsed position and an expanded position, the support frame including a plurality of frame member pairs and a plurality of hubs, each frame member pair including first and second frame members pivotably coupled together to define an X-shape, each first and second frame member being pivotably coupled to the plurality of hubs to permit movement of the support frame between the collapsed and expanded positions, a substantially blank, white projection screen supported by the support frame and made of a polyester fabric, a back sheet positioned between the projection screen and the support frame to protect the projection screen from damage during movement of the support frame to the collapsed position, and at least one lock positioned to block movement of the support frame between the expanded and collapsed positions, the lock including a first telescope member, a second telescope member positioned in the first telescope member, and a lock member configured to selectively block relative movement between the first and second telescope members, the second telescope member being positioned in the first telescope member when the support frame is in the collapsed position.

2. A collapsible display apparatus for use with a projector configured to project an image to be watched by a viewer, the collapsible display apparatus comprising a support frame moveable between a collapsed position and an expanded position, the support frame including a plurality of frame member pairs and a plurality of hubs, each frame member pair including first and second frame members pivotably coupled together to define an X-shape, each first and second frame member being pivotably coupled to the plurality of hubs to permit movement of the support frame between the collapsed and expanded positions, the support frame further including a front side, a back side, a first end, and a second end, a blank, white projection screen supported by the support frame and made of a polyester fabric, the projection screen covering the first and second ends of the support frame and detachably coupling to the back side of the support frame, a black back sheet positioned between the projection screen and the support frame, and a black border sheet positioned to frame the projection screen, the back sheet and border sheet being made of polyester.

3. The collapsible display apparatus of claim 2, wherein the projection screen is coupled to the support frame when the support frame is fully collapsed.

4. The collapsible display apparatus of claim 3, wherein the support frame includes a plurality of frame members cooperating to define a plurality of voids therebetween and portions of the projection screen are positioned in the voids when the support frame is in the collapsed position.

5. The collapsible display apparatus of claim 2, wherein the polyester fabric has a gain of at least about 0.8.

6. A collapsible display apparatus for use with a projector configured to project an image to be watched by a viewer, the collapsible display apparatus comprising a support frame moveable between a collapsed position and an expanded position, the support frame including a plurality of frame member pairs and a plurality of hubs, each frame member pair including first and second frame members pivotably coupled together to define an X-shape, each first and second frame member being pivotably coupled to the plurality of hubs to permit movement of the support frame between the collapsed and expanded positions, a projection screen supported by the support frame, and a back sheet positioned between the projection screen and the support frame during movement of the support frame to the collapsed position to protect the projection screen from damage, wherein the projection screen and the back sheet are made of materials having substantially identical expansion characteristics, the projection screen is made of polyester material, the back sheet is made of polyester material, the projection screen is white, the back sheet is black, the projection screen is permanently coupled to the back sheet, and the back sheet is detachably coupled to the support frame.

7. A collapsible display apparatus comprising a support frame moveable between a collapsed position and an expanded position, the support frame including a plurality of frame member pairs and a plurality of hubs, each frame member pair including first and second frame members pivotably coupled together to define an X-shape, each first and second frame member being pivotably coupled to the plurality of hubs to permit movement of the support frame between the collapsed and expanded positions, a display sheet supported by the support frame, and at least one lock positioned to block movement of the support frame between the expanded and collapsed positions, the lock including a first telescope member, a second telescope member positioned in the first telescope member, and a lock member configured to selectively block relative movement between the first and second telescope members, the first and second telescope members being coupled to the support frame when the support frame is in the collapsed position, the second telescope member being positioned in the first telescope member when the support frame is in the collapsed position.

8. The collapsible display apparatus of claim 7, wherein the first telescope member is permanently coupled to one of the plurality of hubs, the second telescoping member is permanently coupled to one of the plurality of hubs, the lock member is positioned in the second telescope member, the lock member includes a tab positioned in apertures formed in the first and second telescope members and a biaser positioned to urge the tab to a locked position, and the second telescope member is positioned in the first telescope member when the support frame is in the expanded position.

9. The collapsible display of claim 7, wherein at least one of the first and second frame members having has at least one substantially flat sidewall.

10. The collapsible display apparatus of claim 9, wherein each of the first and second frame members includes a plurality of flat sidewalls, at least one of the flat sidewalls of the first frame member faces at least one of the flat sidewalls of the second frame member, the first and second sidewalls are made of extruded aluminum having an octagonal perimeter.

11. A collapsible display apparatus comprising a display sheet, and a support frame supporting the display sheet, the support frame being moveable between a collapsed position and an expanded position, the support frame including a plurality of frame member pairs and a plurality of hubs, each frame member pair including first and second frame members pivotably coupled together by a pin to define an X-shape, each first and second frame member being pivotably coupled to the plurality of hubs to permit movement of the support frame between the collapsed and expanded positions, each of the first and second frame members having a depression defined in an outer surface of the frame members to align a tool adapted to form an aperture in the first and second frames to receive the pin.

12. The collapsible display apparatus of claim 11, wherein the first and second frame members includes a plurality of depressions, each of the plurality of depressions extends along the entire length of the frame members, the first and second frame members includes a plurality of substantially flat sidewalls, each of said depressions is centered on one of the substantially flat sidewalls, and the plurality of depressions are V-shaped.

13. A collapsible display apparatus comprising a support frame moveable between a collapsed position and an expanded position, the support frame including a plurality of frame member pairs and a plurality of hubs, each frame member pair including first and second frame members pivotably coupled together to define an X-shape, each first and second frame member being pivotably coupled to the plurality of hubs to permit movement of the support frame between the collapsed and expanded positions, a substantially blank, white projection screen supported by the support frame, and a border sheet positioned around the projection screen to frame the projection screen and define a perimeter of a viewing surface of the projection screen.

14. The collapsible display apparatus of claim 13, wherein the projection screen and the border sheet are made of materials having substantially identical expansion characteristics, the projection screen is made of polyester material, the border sheet is made of polyester material, the projection screen is white, the border sheet is black, the projection screen is permanently coupled to the border sheet, and the border sheet and projection screen are detachably coupled to the support frame, and the viewing surface of the projection screen has an width-to-height aspect ration greater than 1.3.

15. A collapsible display apparatus comprising a support frame having a front side, a first end, a second end, and a back side, the support frame being moveable between a collapsed position and an expanded position, the support frame including a plurality of frame member pairs and a plurality of hubs, each frame member pair including first and second frame members pivotably coupled together to define an X-shape, each first and second frame member being pivotably coupled to the plurality of hubs to permit movement of the support frame between the collapsed and expanded positions, a display sheet supported on the support frame, the display sheet includes a front panel positioned on the front side of the support frame and a pair of side panels extending along the first and second ends, the side panels including a plurality of fastener-receiving openings, and a plurality of fasteners extending through the fastener-receiving openings to couple the side panels to the support frame and tension the front panel between the side panels.

16. The collapsible display apparatus of claim 15, wherein the plurality of fasteners are positioned on the back side of the support frame, the display sheet covers the first and second ends of the support frame, the plurality of fasteners are coupled to the plurality of hubs of the support frame, each fastener includes a post extending through one of the plurality of fastener-receiving openings and a cross member pivotably coupled to the post.

17. A collapsible display apparatus comprising a support frame moveable between a collapsed position and an expanded position, the support frame including a plurality of frame member pairs and a plurality of hubs, each frame member pair including first and second frame members pivotably coupled together to define an X-shape, each first and second frame member being pivotably coupled to the plurality of hubs to permit movement of the support frame between the collapsed and expanded positions, a blank, white projection screen detachably coupled to the support frames a perimeter of hook-and-loop fasteners bordering the projection screen to detachably couple the projection screen to the support frame, and a flexible perimeter frame positioned along the perimeter of hook-and-loop fasteners to support the projection screen between the plurality of hubs to avoid sagging of the projection screen.

18. The collapsible display apparatus of claim 17, wherein the support frame has a front side, a first end, a second end, and a back side, the projection screen covers the first and second ends and is detachably coupled to the back side of the frame.

* * * * *